US009443506B2

(12) United States Patent
Denney, III

(10) Patent No.: US 9,443,506 B2
(45) Date of Patent: Sep. 13, 2016

(54) HIGH FREQUENCY ENERGY CONVERTER

(71) Applicant: Theodore W. Denney, III, Irvine, CA (US)

(72) Inventor: Theodore W. Denney, III, Irvine, CA (US)

( * ) Notice: Subject to any disclaimer, the term of this patent is extended or adjusted under 35 U.S.C. 154(b) by 92 days.

(21) Appl. No.: 14/510,827

(22) Filed: Oct. 9, 2014

(65) Prior Publication Data

US 2015/0104040 A1 Apr. 16, 2015

Related U.S. Application Data

(60) Provisional application No. 61/889,392, filed on Oct. 10, 2013.

(51) Int. Cl.

| | |
|---|---|
| ***H04R 3/04*** | (2006.01) |
| ***G10K 11/26*** | (2006.01) |
| ***G10K 11/08*** | (2006.01) |

(52) U.S. Cl.

CPC ..... *G10K 11/26* (2013.01); *G10K 11/08* (2013.01); *H04R 3/04* (2013.01)

(58) Field of Classification Search

None

See application file for complete search history.

(56) References Cited

U.S. PATENT DOCUMENTS

| | | | | |
|---|---|---|---|---|
| 1,688,744 | A * | 10/1928 | Nicolson | H04R 1/403 181/188 |
| 2,102,668 | A * | 12/1937 | Ballantine | H04R 17/00 181/159 |
| 4,381,831 | A * | 5/1983 | Putnam | G10K 11/025 181/152 |
| 2002/0000681 | A1* | 1/2002 | Gupta | A61K 9/14 264/9 |
| 2003/0132056 | A1* | 7/2003 | Meyer | G10K 11/025 181/187 |
| 2015/0104040 | A1* | 4/2015 | Denney, III | G10K 11/00 381/98 |

FOREIGN PATENT DOCUMENTS

JP 56111395 A * 9/1981

* cited by examiner

*Primary Examiner* — Peter Vincent Agustin
(74) *Attorney, Agent, or Firm* — Morland C. Fischer

(57) ABSTRACT

A high frequency energy converter which has application as an acoustic actuator for converting incoming high frequency energy into outgoing harmonized high frequency mechanical (e.g., sound) and electromagnetic waves. The energy converter is adapted to improve the quality of sound heard by a listener by reducing random and spurious harmonics that are introduced by the environment in which the listener is located. The energy converter includes an outer body and a reactive crystalline material (e.g., quartz) lying at the bottom of the outer body that is responsive to the incoming high frequency energy. A dispersion horn is located at the top of the outer body to be seated upon the crystalline material. The dispersion horn has a throat extending therethrough so that both incoming high frequency energy and outgoing high frequency mechanical and electromagnetic waves are transmitted through the throat of the horn in opposite directions.

13 Claims, 4 Drawing Sheets

HIGH FREQUENCY ENERGY CONVERTER

CROSS REFERENCES TO RELATED APPLICATIONS

This application is related to Provisional Application No. 61/889,392 filed Oct. 10, 2013.

BACKGROUND OF THE INVENTION

1. Field of the Invention

This invention relates to a high frequency energy converter which, in a preferred embodiment, functions as an acoustic actuator (i.e., resonator) for treating high frequency acoustic and electromagnetic energy and producing harmonized high frequency mechanical (e.g., sound) and electromagnetic waves in response thereto. The energy converter has particular application for improving the quality of audible sound by reducing random and spurious harmonics and noise caused by room acoustics in order to produce a more natural and pleasing sound to the ears of a listener.

2. Background Art

The quality of high frequency energy (i.e., sound waves) can be negatively impacted by a variety of causes. For example, audio noise can be introduced at the source which results in sound distortion. Sound distortion can also occur when the contents of a room resonate out of tune with one another. In this same regard, the acoustics of the room in which the source of sound and the listener are located can often generate spurious and random harmonics that interfere with the ability of the listener to clearly hear the sound being transmitted across the room.

Apparatus to cancel audio noise and improve sound quality are known. However, such apparatus are relatively complex and correspondingly expensive. Moreover, the conventional audio apparatus are not commonly adapted to treat sound waves and eliminate harmonics which are introduced as a consequence of the acoustics of the particular room in which the source of the sound and the listener are located. What is therefore needed is a low cost, compact and easy-to-use high frequency energy converter which can be conveniently located throughout a room or at an audio source to reduce the effects of random and spurious harmonics in sound waves to produce a more natural and pleasing sound to the ear of the listener.

SUMMARY OF THE INVENTION

In general terms, a low cost, compact and easy-to-use high frequency energy converter is disclosed which, in a preferred embodiment, functions as an acoustic actuator (i.e., resonator) for treating high frequency acoustic and electromagnetic energy that is transmitted between a source of the high frequency energy and the ears of a listener. The high frequency energy converter includes an outer body (e.g., a cylindrical cup) that surrounds a hollow chamber. Located at the bottom of the hollow chamber of the outer cup is a crystalline material (e.g., quartz) that resonates in response to the high frequency energy generated by the source. The crystalline material is excited by the high frequency energy and generates high frequency mechanical (e.g., sound) and electromagnetic waves to the listener's ears.

A cover (e.g., a screen) is located across the crystalline material to prevent the material from falling outwardly from the hollow chamber of the outer cup of the high frequency energy converter. A dispersion horn that is manufactured from a sound-reflecting material (e.g., aluminum) is seated atop the cover inside the outer cup. The horn has a (e.g., funnel-shaped) throat running therethrough which extends from the top of the outer cup to the cover which lies across the crystalline material at the bottom of the outer cup below the cover.

A plurality of the high frequency energy converters can be (e.g., adhesively) attached to the walls of a room within which the source of sound and the listener are located. Incoming high frequency acoustic and electromagnetic energy travels in a first direction down the throat of the dispersion horn of each energy converter to excite the crystalline material which lies below the horn. The crystalline material reacts to the incoming high frequency energy so as to remove random and spurious harmonics which are often introduced by the acoustics of the room in which the energy converters are located. The crystalline material of the high frequency energy converters produce high frequency mechanical (e.g., sound) and electromagnetic waves in which interference-producing harmonics in the audio frequency range are reduced. These high frequency waves travel upwardly through the throat of each dispersion horn so as to make the audible sound within the room clearer, less distorted and more pleasing to the ears of the listener.

DESCRIPTION OF THE PREFERRED EMBODIMENT

Figure 1:
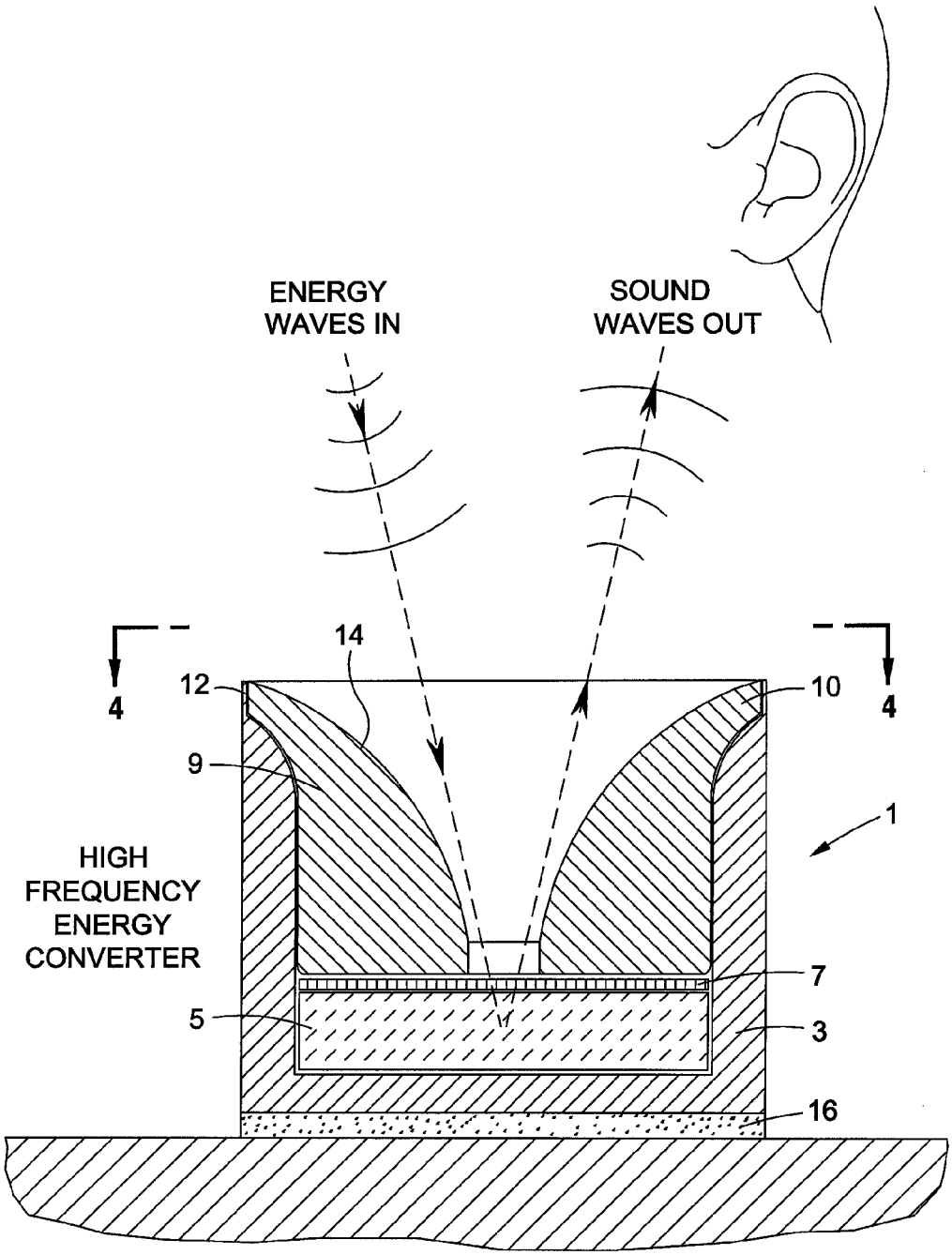
FIG. 1 is a cross-section of a high frequency energy converter according to a first preferred embodiment of this invention having particular application as an acoustic actuator to treat high frequency acoustic and electromagnetic energy within an environment within which the energy converter is located.
Figure 2:
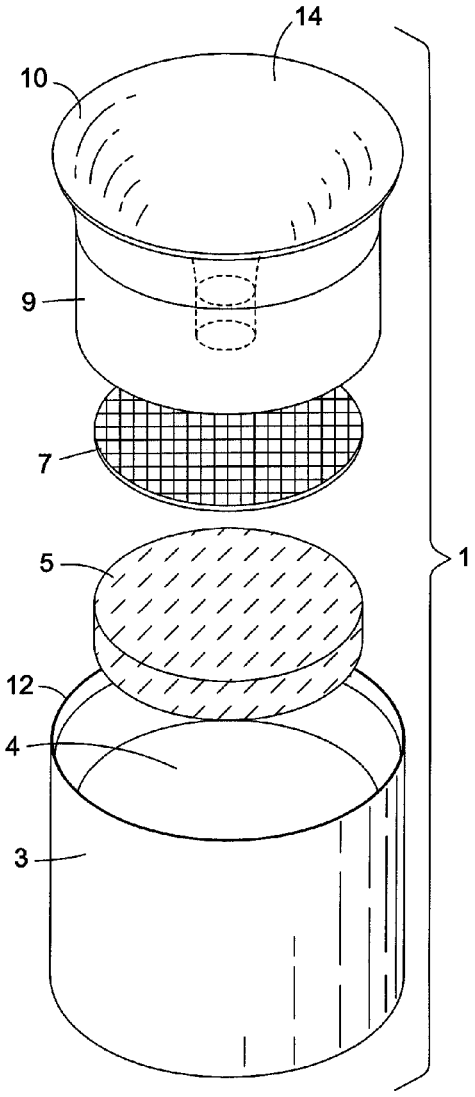
FIGS. 2 and 3 are exploded views of the high frequency energy converter shown in FIG. 1.
Figure 3:
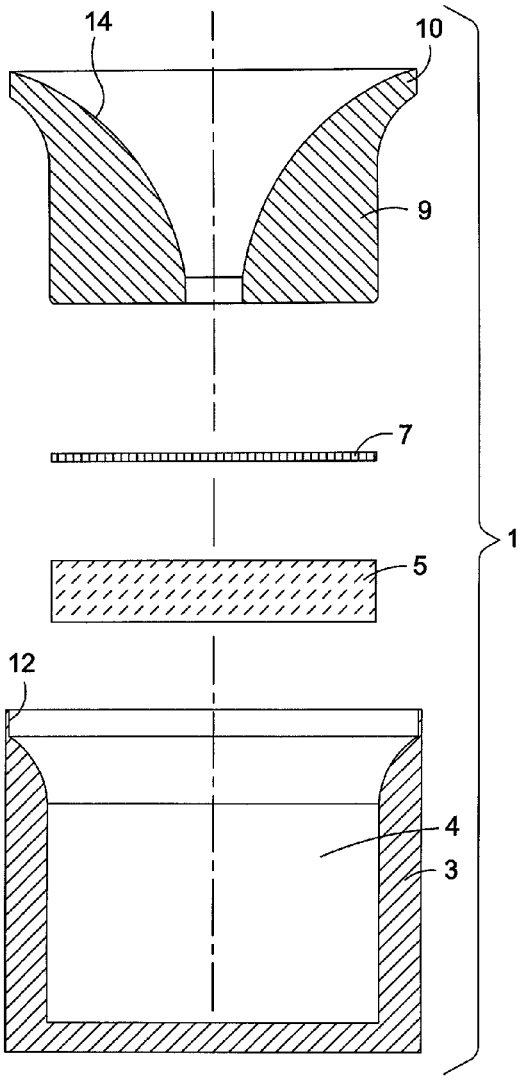
Figure 4:
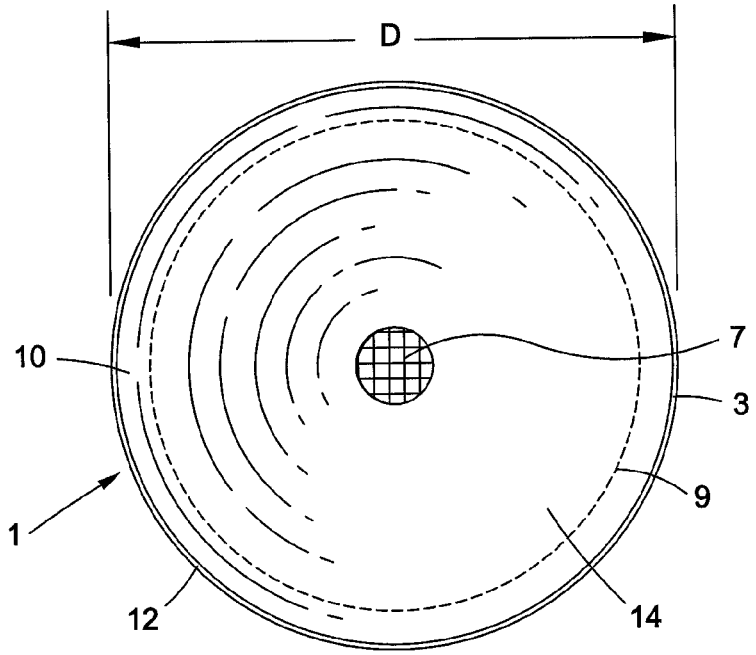
FIG. 4 is a top view of the high frequency energy converter of FIG. 1.

A first preferred embodiment for a low cost, compact and easy-to-use high frequency energy converter 1 is described while referring concurrently to FIGS. 1-4 of the drawings. Although the high frequency energy converter 1 of this invention has particular application as an acoustic actuator (i.e., resonator) for treating high frequency acoustic energy, the converter 1 will also be responsive to other electromagnetic energy such as, for example, radio waves.

To this end, the dimensions of the energy converter 1 can vary depending upon its application and location. As will be explained in greater detail when referring to FIG. 6, the energy converter 1 may be mounted on a wall of a room to enhance the quality of sound generated inside the room by an audio source and transmitted to the ears of a listener. In this case, the high frequency energy converter 1 can have a generally cylindrical shape with a height and a diameter (designated D in FIG. 4) of about 10 mm. However, it is to be understood that the particular shape and dimensions of energy converter 1 are not to be considered as limitations of this invention.

The high frequency energy converter 1 of FIGS. 1-4 is shown having an outer cylindrical cup 3 that is manufactured from aluminum or any other suitable durable material. The bottom of the cup 3 is closed and the top is opened to establish a hollow chamber 4 at the interior of the cup. Located at the bottom of the cup 3 within the hollow chamber 4 thereof is a crystalline material 5. By way of example, the crystalline material 5 is quartz. However, any other suitable natural or man-made crystalline material, such as tormalene or amethyst, that resonates in response to high frequency acoustic and electromagnetic energy may be located at the bottom of the cup 3. It is preferable that the crystalline material 5 be responsive to a wide frequency band common to radio signals, earth-generated Schumann resonances, ELF to microwave signals, electric lighting and electric generators. In the energy converter shown in FIGS. 1-4, the crystalline material 5 has a disk or wafer configuration. As an alternative, the crystalline material 5 can be loaded into the cup 3 as tightly-packed granules.

To prevent the crystalline material 5 from falling out of the interior chamber 4 of the outer cup 3 of the high frequency energy converter 1, a cover 7 is placed across over the material 5. The cover 7 can be manufactured from any suitable material that will permit the transmission of high frequency energy therethrough. By way of example, the cover 7 can be a screen or have a mesh configuration. The cover 7 may be sized to be frictionally engaged by and held in place inside the cup 3 so as to lie across the crystalline material 5. In the alternative, the cover 7 can be adhesively bonded to the interior chamber 4 of the cup 3 or received within a circumferential groove (not shown) formed around the inside cup 3.

The high frequency energy converter 1 also includes a flared dispersion horn 9 that is located inside the chamber 4 at the top of the outer cup 3 so as to be seated upon the cover 7 above the crystalline material 5. The horn 9 is preferably manufactured from aluminum or any other suitable material that will reflect (i.e., disperse) high frequency energy (e.g., sound waves). The dispersion horn 9 may be sized to be frictionally engaged by and held in place inside the chamber 4 of the cup so as to sit upon the cover 7. In the alternative, the horn 9 may be adhesively bonded to the chamber 4 of the outer cup 3. What is more, the top of the horn 9 may have an outwardly-flared peripheral lip 10 that is pressed into and held against a correspondingly shaped recess 12 formed around the top edge of cup 3.

As an important feature of the high frequency energy converter 1, the dispersion horn 9 located inside the outer cup 3 has a throat 14 which extends longitudinally therethrough so as to be coaxially aligned with the cylindrical cup 3. The throat 14 establishes a path through the horn 9 for incoming high frequency acoustic and electromagnetic energy to travel in a first direction downwardly through the horn to the crystalline material 5 that lies between the cover 7 and the bottom of the outer cup 3.

The crystalline material 5 below the dispersion horn 9 of the high frequency energy converter 1 is excited and caused to resonate by the incoming high frequency acoustic and electromagnetic energy. The reaction of the crystalline material 5 to the high frequency energy reduces random and spurious interference-producing harmonics and noise introduced by the environment within which the energy converter 1 is located. In this same regard, the crystalline material 5 generates and transmits outgoing high frequency mechanical (e.g., sound) and electromagnetic waves in an opposite direction upwardly through the throat 14 of the horn 9. In the preferred embodiment, positioning a plurality of the high frequency energy converters 1 of this invention in an audio listening environment improves the clarity and quality of sound being transmitted within the environment by substantially eliminating unwanted electromagnetic and mechanical noise that adversely affects the audio frequency range so that the sound will be more pleasing to the ear of a listener.

The high frequency waves that are produced by the high frequency energy converter 1 are dispersed into the environment according to the profile of the throat 14 through the dispersion horn 9. In the example shown in FIGS. 1-4, the throat 9 is funnel shaped so as to be wider at the top and narrower at the bottom adjacent the cover 7.

Figure 5:
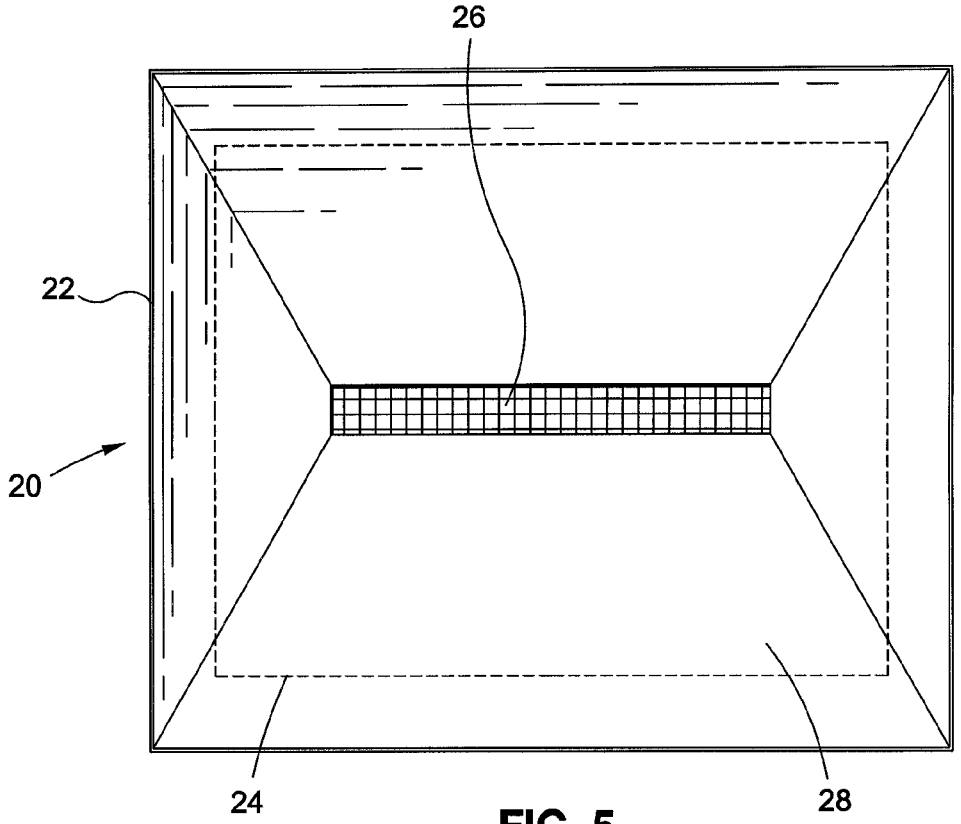
FIG. 5 is a top view of a high frequency energy converter according to a second preferred embodiment of this invention.

In FIGS. 1-4, the high frequency energy converter 1 is shown as having a cylindrical outer cup 3 and a dispersion horn 9 having a funnel shaped throat 14 extending therethrough. However, the energy converter may have shapes other than that shown in FIGS. 1-4. For example, FIG. 5 of the drawings shows a high frequency energy converter 20 according to a second preferred embodiment which has a rectangular or square outer body 22. The energy converter 20 has a correspondingly shaped rectangular or square dispersion horn 24 received within and surrounded by the outer body 22. The horn 24 is seated upon a cover 26 which lies atop a reactive crystalline material (not shown).

As in the case of the high frequency energy converter 1, a throat 28 runs through the dispersion horn 24 from the top of the outer body 22 to the cover 26 through which incoming high frequency acoustic and electromagnetic energy and outgoing high frequency waves are transmitted in opposite directions. The high frequency energy converter 20 of FIG. 5 has particular application as an acoustic actuator for treating high frequency acoustic energy so that sound emanating from a source will be clearer and more pleasing to the ears of a listener located within the environment in which the energy converter 20 is used.

Figure 6:
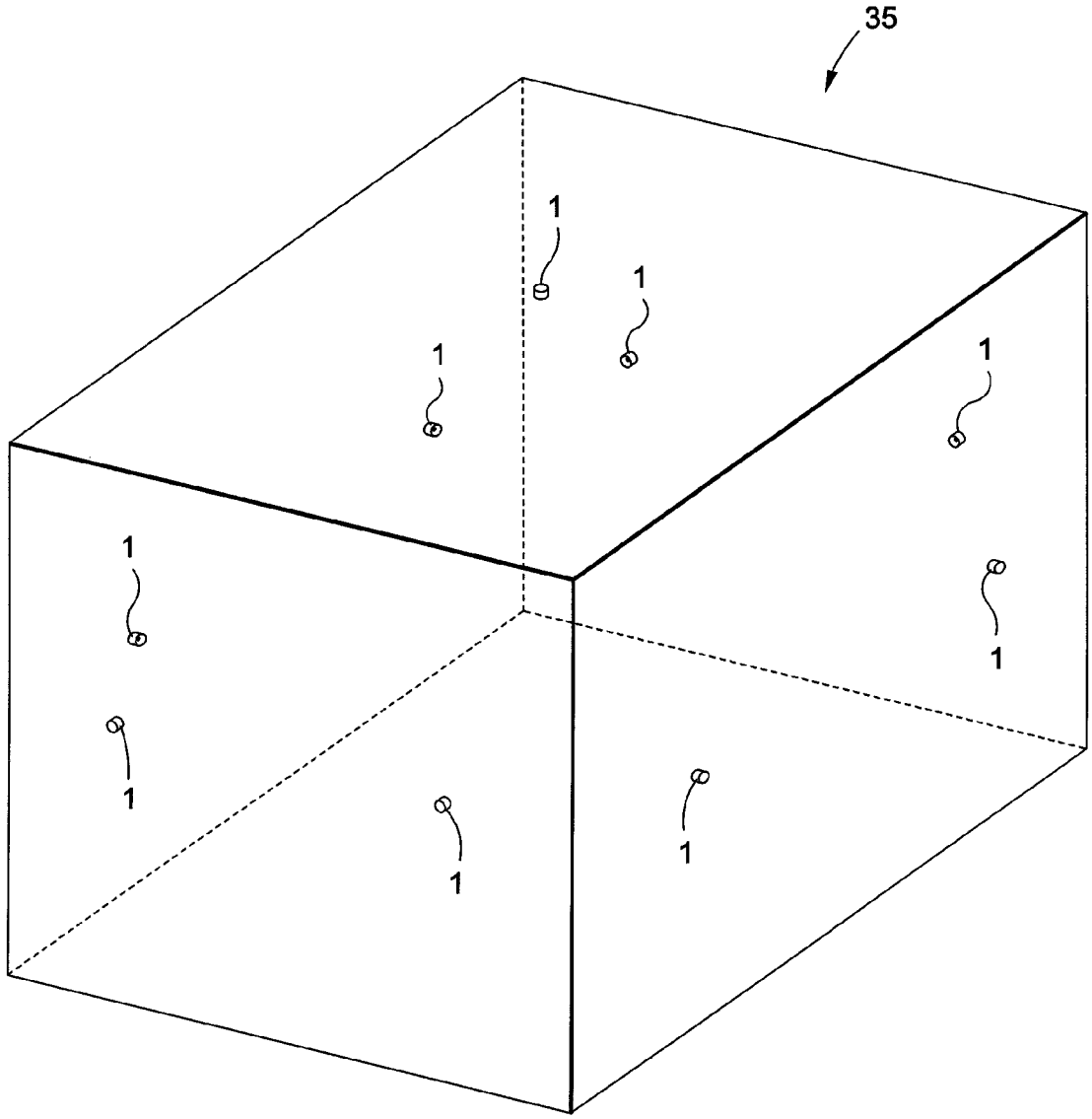
FIG. 6 shows a plurality of the high frequency energy converters of FIGS. 1-4 located on the walls of a room to treat high frequency acoustic and electromagnetic energy being transmitted therewithin.

Turning now to FIG. 6 of the drawings, there is shown a room 35 having top, bottom and side walls to create an environment within which a plurality of the high frequency energy converters (e.g., like that designated 1 in FIGS. 1-4) are used to convert high frequency acoustic and electromagnetic energy into cleaner and more harmonized energy waves which positively affect the audible frequency range by improving the clarity and quality of sound being heard by a listener located in the room. The energy converters 1 are attached to some or all of the walls of the room by means of a suitable adhesive (designated 16 in FIG. 1). The number and location of the energy converters 1 on the walls are dependent upon the source of the high frequency energy and the acoustics of the room 35. By virtue of the high frequency energy converters 1, the sound detected by the ears of the listener will appear more natural and noise free.

The high frequency energy converters 1 and 20 disclosed herein can be used in a room 35 like that shown in FIG. 6 with high fidelity music or with car audio systems as well as in theaters, concert halls, arenas and other areas in which music, sound or dialog will be transmitted to a listener. One or more of the energy converters may also be applied directly to or alongside an audio component, such as a speaker, or any source of high frequency acoustic or electromagnetic energy, including a printed circuit board.

The invention claimed is:

1. An acoustic energy converter for reducing interference-producing harmonics in the audio frequency range in incoming high frequency energy applied to said acoustic energy converter, said energy converter comprising:

a cylindrical body having a top and a bottom and a chamber located at the interior of said cylindrical body between the top and the bottom thereof;

a crystalline material located within the chamber of said cylindrical body and lying at the bottom of said cylindrical body, said crystalline material resonating in response to the incoming high frequency energy applied to said energy converter and generating outgoing electromagnetic and mechanical waves in which said interference-producing harmonics in the audio frequency range in said incoming high frequency energy have been reduced; and a dispersion horn located within said chamber at the top of said cylindrical body above said crystalline material, said dispersion horn having a throat extending therethrough, said throat being aligned with the crystalline material such that the incoming high frequency energy which is applied to said energy converter is transmitted in a first direction to the crystalline material by way of the throat of said dispersion horn, and the outgoing electromagnetic and mechanical waves generated by said crystalline material are transmitted in an opposite direction through the throat of said dispersion horn.

2. The acoustic energy converter recited in claim 1, wherein said dispersion horn is seated upon said crystalline material within the chamber of said cylindrical body.

3. The acoustic energy converter recited in claim 1, further comprising a cover positioned between said dispersion horn and said crystalline material within the cylindrical chamber of said body.

4. The acoustic energy converter recited in claim 3, wherein the cover positioned between said dispersion horn and said crystalline material is adapted to pass said incoming high frequency energy and said outgoing electromagnetic and mechanical waves that are transmitted in said first and opposite directions through the throat of said dispersion horn.

5. The acoustic energy converter recited in claim 3, wherein the cover positioned between said dispersion horn and said crystalline material is a screen.

6. The acoustic energy converter recited in claim 1, wherein the throat which extends through said dispersion horn is a funnel having a wide end located adjacent the top of said cylindrical body and a narrow end located adjacent said crystalline material within the chamber at the bottom of said cylindrical body.

7. The acoustic energy converter recited in claim 1, wherein said dispersion horn is positioned with respect to said crystalline material so as to reflect the outgoing electromagnetic and mechanical waves generated by said crystalline material and transmitted in the opposite direction through the throat of said dispersion horn.

8. An acoustic energy converter system for reducing interference-producing harmonics in incoming high frequency energy applied to said system and transmitted within a room having a plurality of walls, said energy converter system having a plurality of acoustic energy converters attached to respective ones of said plurality of walls, and each of said plurality of acoustic energy converters comprising:

a body having a chamber with an open top and a closed bottom;

a crystalline material located at the closed bottom of the chamber of said body, said crystalline material resonating in response to the incoming high frequency energy applied to said energy converter and generating outgoing electromagnetic and mechanical waves in which said interference-producing harmonics in the audio frequency range have been reduced; and a dispersion horn located at the open top of the chamber of said body above said crystalline material, said dispersion horn having a throat extending therethrough, said throat being aligned with the crystalline material such that the incoming acoustic energy that is applied to said plurality of energy converters is transmitted in a first direction to the crystalline material of each of said energy converters by way of the throat of the dispersion horn thereof, and the outgoing electromagnetic and mechanical waves generated by the crystalline material of each of said energy converters are transmitted in an opposite direction through the throat of said dispersion horn thereof.

9. An acoustic energy converter for reducing interference-producing harmonics in the audio frequency range in incoming high frequency energy applied to said acoustic energy converter, said energy converter comprising:

a rectangular body having a top and a bottom and a chamber located at the interior of said rectangular body between the top and the bottom thereof;

a crystalline material located within the chamber of said rectangular body and yin at the bottom of said rectangular body, said crystalline material resonating in response to the incoming high frequency energy applied to said energy converter and generating outgoing electromagnetic and mechanical waves in which said interference-producing harmonics in the audio frequency range in said incoming high frequency energy have been reduced; and a dispersion horn located within said chamber at the top of said rectangular body above said crystalline material, said dispersion horn having a throat extending therethrough, said throat being aligned with the crystalline material such that the incoming high frequency energy which is applied to said energy converter is transmitted in a first direction to the crystalline material by way of the throat of said dispersion horn, and the outgoing electromagnetic and mechanical waves generated by said crystalline material are transmitted in an opposite direction through the throat of said dispersion horn.

10. The acoustic energy converter recited in claim 9, wherein said dispersion horn is seated upon said crystalline material within the chamber of said rectangular body.

11. The acoustic energy converter recited in claim 9, further comprising a cover positioned between said dispersion horn and said crystalline material within the chamber of said rectangular body.

12. The acoustic energy converter recited in claim 9, wherein the throat which extends through said dispersion horn is a funnel having a wide end located adjacent the top of said rectangular body and a narrow end located adjacent said crystalline material within the chamber at the bottom of said rectangular body.

13. The acoustic energy converter recited in claim 9, wherein said dispersion horn is positioned with respect to said crystalline material so as to reflect the outgoing electromagnetic and mechanical waves generated by said crystalline material and transmitted in the opposite direction through the throat of said dispersion horn.

* * * * *